US009556621B2

(12) United States Patent
Pelc et al.

(10) Patent No.: US 9,556,621 B2
(45) Date of Patent: Jan. 31, 2017

(54) PEDESTAL ELEVATION SYSTEM

(71) Applicant: The Ipe Clip Fastener Company, LLC, Bradenton, FL (US)

(72) Inventors: Robert J. Pelc, Sarasota, FL (US); James Dean Upchurch, Parrish, FL (US)

(73) Assignee: The Ipe Clip Fastener Company, LLC, Bradenton, FL (US)

( * ) Notice: Subject to any disclaimer, the term of this patent is extended or adjusted under 35 U.S.C. 154(b) by 0 days.

(21) Appl. No.: 14/775,680

(22) PCT Filed: Mar. 13, 2014

(86) PCT No.: PCT/US2014/025768
§ 371 (c)(1),
(2) Date: Sep. 12, 2015

(87) PCT Pub. No.: WO2014/160076
PCT Pub. Date: Oct. 2, 2014

(65) Prior Publication Data

US 2016/0040439 A1 Feb. 11, 2016

Related U.S. Application Data

(60) Provisional application No. 61/779,085, filed on Mar. 13, 2013.

(51) Int. Cl.
*E04F 15/024* (2006.01)

(52) U.S. Cl.
CPC ..... *E04F 15/02482* (2013.01); *E04F 15/0247* (2013.01); *E04F 15/02452* (2013.01)

(58) Field of Classification Search
CPC ..... E04F 15/02482; E04F 15/02452; E04F 15/02464; E04F 15/0247; E04F 15/02476
See application file for complete search history.

(56) References Cited

U.S. PATENT DOCUMENTS 2,867,301 A * 1/1959 Benton ..... E04F 15/02405 52/220.3
2,956,653 A * 10/1960 Liskey, Jr. ..... E04F 15/02405 254/133 A (Continued)

FOREIGN PATENT DOCUMENTS

AU WO 2007048204 A1 * 5/2007 ..... E04F 15/02476
BE EP 2610416 A1 * 7/2013 ..... E04F 15/02482

(Continued)

*Primary Examiner* — Joshua J Michener
*Assistant Examiner* — Keith Minter
(74) *Attorney, Agent, or Firm* — Patricia M. Costanzo

(57) ABSTRACT

An elevating leveling pedestal having a base rotatably attached to a first coupling end to collectively create a height adjustment mechanism, a second coupling end non-rotatably attached to a first end of a non-threaded midsection of predetermined length with a second end non-rotatably attached to a head assembly to support, secure, and level a surface installed over a non-sloping or sloping sub-surface. The head assembly comprising a support-head overlying and attached to a cap with either the support-head or the cap having a convex mating surface and the other having a concave mating surface making the support-head and the cap slidably re-positionable with respect to each other along their mating surface resulting in the support-head being tiltable with respect to said cap from zero to seven degrees. A recess is formed in a bottomed-well in the support surface of the support-head for supporting a double-ended bushing to interact with locking devices.

20 Claims, 11 Drawing Sheets

(56) References Cited

U.S. PATENT DOCUMENTS 3,100,624 A * 8/1963 Spiselman ..... E04F 15/0247 248/161
3,222,030 A * 12/1965 Thorpe ..... E04F 15/02452 248/354.3
3,470,663 A * 10/1969 Tate ..... E04F 15/02482 248/188.3
3,924,370 A * 12/1975 Cauceglia ..... E04F 15/02435 52/126.6
4,319,520 A * 3/1982 Lanting ..... F24F 7/10 454/290
4,637,181 A * 1/1987 Cohen ..... E04F 15/02452 52/126.5
5,398,466 A * 3/1995 Oyama ..... E04F 15/02482 52/126.6
6,101,768 A * 8/2000 Springstead ..... E04F 15/02405 454/334
6,463,704 B1 * 10/2002 Jette ..... E04F 15/02458 52/125.2
6,519,902 B1 * 2/2003 Scissom ..... E04F 15/02458 52/126.4
6,637,161 B1 * 10/2003 Buchalter ..... E04F 15/02447 52/126.6
7,165,361 B2 * 1/2007 Vanagan ..... E04G 7/307 182/141
7,360,343 B1 * 4/2008 Spransy ..... E04F 15/02452 52/263
8,898,999 B1 * 12/2014 Kugler ..... E04F 15/02464 52/126.6
2003/0070372 A1 * 4/2003 Favero ..... E04D 11/007 52/220.1
2004/0035064 A1 * 2/2004 Kugler ..... E04F 15/02183 52/126.6
2004/0055232 A1 * 3/2004 Jette ..... H02G 3/285 52/220.1
2004/0163350 A1 * 8/2004 Huang ..... E04F 15/02452 52/506.06
2004/0261329 A1 * 12/2004 Kugler ..... E04F 15/02183 52/126.6
2007/0063101 A1 * 3/2007 Tiid ..... B64D 9/003 244/118.5
2009/0183442 A1 * 7/2009 Repasky ..... E04D 11/007 52/126.6
2010/0000163 A1 * 1/2010 Tsai ..... E04F 15/02405 52/126.6
2011/0016809 A1 * 1/2011 Knight, III ..... E04D 11/007 52/263
2011/0023385 A1 * 2/2011 Knight, III ..... B66F 3/08 52/126.6
2011/0232208 A1 * 9/2011 Tabibnia ..... E04F 15/02452 52/126.6
2014/0123576 A1 * 5/2014 Meyer ..... E04F 15/02452 52/126.6
2014/0145042 A1 * 5/2014 Adamson ..... F16M 11/046 248/125.8

FOREIGN PATENT DOCUMENTS

DE 102010032452 A1 * 2/2012 ..... E04F 15/0247
JP WO 2011016453 A1 * 2/2011 ..... E04F 15/02452

* cited by examiner

SECTION A-A

DETAIL C

DETAIL B

PEDESTAL ELEVATION SYSTEM

CROSS-REFERENCE TO RELATED APPLICATIONS

This is a National Filing under 35 U.S.C. 371 of PCT/US2014/025768 with an International Filing Date of Mar. 13, 2014 that relied on Provisional Application No. 61/779,085 filed Mar. 13, 2013.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND

The present invention relates generally to a device and a method for supporting a structure above a fixed surface, and more particularly, to a height and slope adjustable pedestal device made using a single length of unthreaded piping, the rotatable device base having minimal surface threading, and the device head able to be locked in a zero or non-zero slope for supporting a structure above a fixed surface, and the method of using such a device.

The background information discussed below is presented to better illustrate the novelty and usefulness of the present invention. This background information is not admitted prior art.

Elevating pedestal support devices are used, for example, when an elevated floor is required, such as when wiring, water pipes, and/or heating and cooling piping must be installed between a floor and sub-surface, or in many instances for deck installations. Floors supported by pedestals, are often referred to as pedestal floors. The supporting pedestals are uniformly distributed over a sub-surface to cooperate in supporting floor panels such as pavers or decking boards. The sub-surface may be a horizontally level concrete floor, a roof, or any other surface on top of which it is desired to locate an elevated floor. For these uses the elevating support pedestals need only be height adjustable. Substrates, however, are often not horizontal, such as roof surfaces that are generally sloped at a given angle from the horizontal for the purpose of draining rainfall and melting snow and ice. In these instances, in order to provide for the installation of a horizontally flat floor over a sloping sub-surface, the support pedestals need to be both height and slope adjustable.

Elevated deck construction, especially on sloped roofs, is gaining in popularity. Elevated deck floors often are made of deck-tiles, supported and connected by an array of pedestals. A deck tile typically consists of a 24"×24" square assembly of deck boards that are used primarily for patios and rooftop lounge areas. It is these deck-tiles that must be installed over and elevated up from a non-level roof surface to create a new, level walking deck surface, or optionally a sloped ramped surface.

SUMMARY

The present inventive concept is to provide height and slope adjustable pedestals that are strong, can be securely locked in a sloped or non-sloped position to securely maintain their height and slope, are cost effect, readily available, and easy to install. To make his concept a reality, the present Inventor developed a set of inventive principles to provide devices to support and attach a level walking surface over a first level or non-level sub-surface.

For the purpose of fully illustrating the inventive principles, one exemplar pedestal device is presented herein and referred to as a pedestal elevation system for the installation of decking tiles over level or non-level surfaces. As mentioned above, deck-tiles are typically a 24"×24" square assembly of deck boards. The pedestal elevation system, as taught herein, securely connects such deck-tiles to each other as well as to the surface over which the deck-tiles are being installed and ensures that the newly installed deck-tiles, regardless of being installed either on a flat or a sloping surface of a pitched roof, present a level floor surface.

The leveling, elevating pedestals include a rotatable means that consists of a threaded pedestal base that is rotatably attached to a threaded first end of a coupling, whereas the combination provides for each pedestal to be independently height adjustable, that is, each pedestal is easily adjusted to a specified height and can be rapidly and easily raised or lowered relative to the sub-surface for fine adjustments. A non-threaded second end of the coupling supports and is non-rotatably fastened to a non-threaded first end of a midsection of a predetermined length. A non-threaded second end of the midsection is not-rotatably attached to and supports a lockable, leveling (tilting) support-head, thus creating a pedestal that is able to compensate for any sloping or uneven surfaces over which deck-tiles are being installed as it is connecting deck-tiles to each other at their corner sites. This design provides for each pedestal to independently support each deck tile, as required (described in more detail below). One pedestal can provide support for and attach the intersecting corners of up to four deck-tiles. Each pedestal, once completely installed and tightened in place, using a tightening bolt, secures the surface it is supporting. However, the pedestal can be easily and rapidly accessed to make any required adjustments by simply loosening the tightening bolt. Additionally, if desired, one skilled in the art would be able to adapt the pedestal to be used in its reverse orientation.

To ensure that the surface being installed, such as a surface made-up of deck-tiles, is secured from being uplifted from its subsurface, due, for example, to a wind storm, each elevating pedestal has a platy locking element as part of the pedestal that, as the tiles are laid, is positioned within grooves pre-cut into the side of the deck-tiles. An example of such a locking element is a plastic coated metal washer with a distinctive property. The washer, according to the inventive concept, is caused to have a narrow elongate slot emanating from the center of the washer through to its perimeter, thus having its length that of a radius of the washer. This slot is unlike the slot of any other similar device. Other devices offer a "pac-man like", that is, a large-angle cut-out on each washer that can be described as a notch intersecting the washer perimeter to its center point of from approximately 105° to 130° wide. A notch of this width necessarily greatly decreases the surface area of the washer that, in turn, both greatly decreases the strength of the washer's hold-down capacity and provides much less surface to support each deck tile. In addition, getting the washers with the large-area slot into aligned engagement with the corners of each of the deck-tiles the pedestal is supporting requires time consuming adjustment of the washer to assure that as much surface of the washer as possible is supporting a deck-tile. In comparison, the width of the elongate slot of the washer of the present invention is limited to being only wide enough to have the slot fit about the stem of the center tightening bolt, but not so wide as to fit about the head of the bolt. This design makes it possible for the washer to offer maximum hold-down strength and maximum surface area to more fully engage with the corner cut-outs of all four deck-tiles. Additionally, the narrow elongate slot provides for the washer to be simply slid into, and out of, engagement with the deck-tiles.

There is a center tightening bolt combined with a double-ended, multi-purpose bushing that is used to tighten the head and the uplift fastener in place. The tightening bolt locks the tiltable, leveling head either in a level horizontal position or in a tilted position, which is a unique feature. There is also a locking washer (as discussed in more detail below) that serves to secure the tiltable leveling pedestal head in place. Some presently available devices provide for limited degrees of leveling, but they cannot be locked into infinitely varied angled positions as can the present invention. The leveling head of the present invention is infinitely adjustable between a zero percent slope and an approximate seven percent slope. The present invention provides locking means for the leveling head to be a lockable stationary head by, in the example as shown, the use of a zero compensator washer (zeroing plug) that can rapidly and easily lock the leveling head to zero degrees. Designing the leveling head as a stationary head accurately zeroed provides the additional advantage of decreasing the installation time on top of level surfaces and, also, securely locks the head in the zero degree position, where currently available adjustable heads may easily slip out of the zero degree position. When installation is on a sloped surface, the zero compensator washer is removed, the head tilted to the required slope, and then locked into that position using the locking washer. The head is locked into position from the top side by using the center tightening bolt that is tightened into double-ended, multi-purpose bushing bolt mechanism. As mentioned, the tightening bolt fastener secures the multi-purpose bushing in place at the desired slope and also further secures the deck-tiles to the head. The leveling head also includes four tabs, each positioned at right angles to its neighbor tab, for the correct spacing of the elevated surface pieces being installed or, alternatively, the upper surface of the head is fitted with a joist support for the installation of elevated joists.

To elevate the pedestal to various heights ranging up to about 30 inches above the subsurface over which the deck-tiles are being installed, the example of the present invention illustrated herein uses predetermined lengths of unthreaded PVC pipe as its mid-section (also referred to as its main pedestal support section) and, as explained above, in conjunction with the threaded coupling section and its receiving base provides for final, small scale adjustments. As described above, the threaded coupling section rotatably connects the main pedestal support section to the threaded base. In this example, the base is internally threaded to accept the externally threaded portion of the coupling section. Many of the devices presently available rely on all of their pipe sections being threaded in order to achieve a desired height. The present invention does include a threaded section that is employed for final, fine adjustments, but the main elevating and support section of the pedestal relies on lengths of custom cut unthreaded PVC pipe, for several reasons. Unthreaded PVC pipe provides added strength and rigidity over the currently available systems, as threaded elongate sections tend to have less strength, be less rigid, and thus, be wobbly. Moreover, unthreaded PVC pipe is readily available because such pipe can be found in most home stores ready to be cut to the desired length. The use of unthreaded PVC pipe also reduces cost, while creating a more rigid, stronger pedestal. The use of the unthreaded PVC pipe also improves installation time since it greatly reduces the number of threaded components which other devices require you to "gang" together to achieve the height required.

Additionally, if desired there is provided a self-leveling head with a joist support that includes a slide feature to permit joists of different widths to be securely fit therein.

Still other benefits and advantages of this invention will become apparent to those skilled in the art upon reading and understanding the following detailed specification and related drawings.

BRIEF DESCRIPTION OF THE DRAWINGS

In order that these and other objects, features, and advantages of the present invention may be more fully comprehended and appreciated, the invention will now be described, by way of example, with reference to specific embodiments thereof which are illustrated in appended drawings wherein like reference characters indicate like parts throughout the several figures. It should be understood that these drawings only depict preferred embodiments of the present invention and are not therefore to be considered limiting in scope, thus, the invention will be described and explained with additional specificity and detail through the use of the accompanying drawings, in which.

Figure 1:
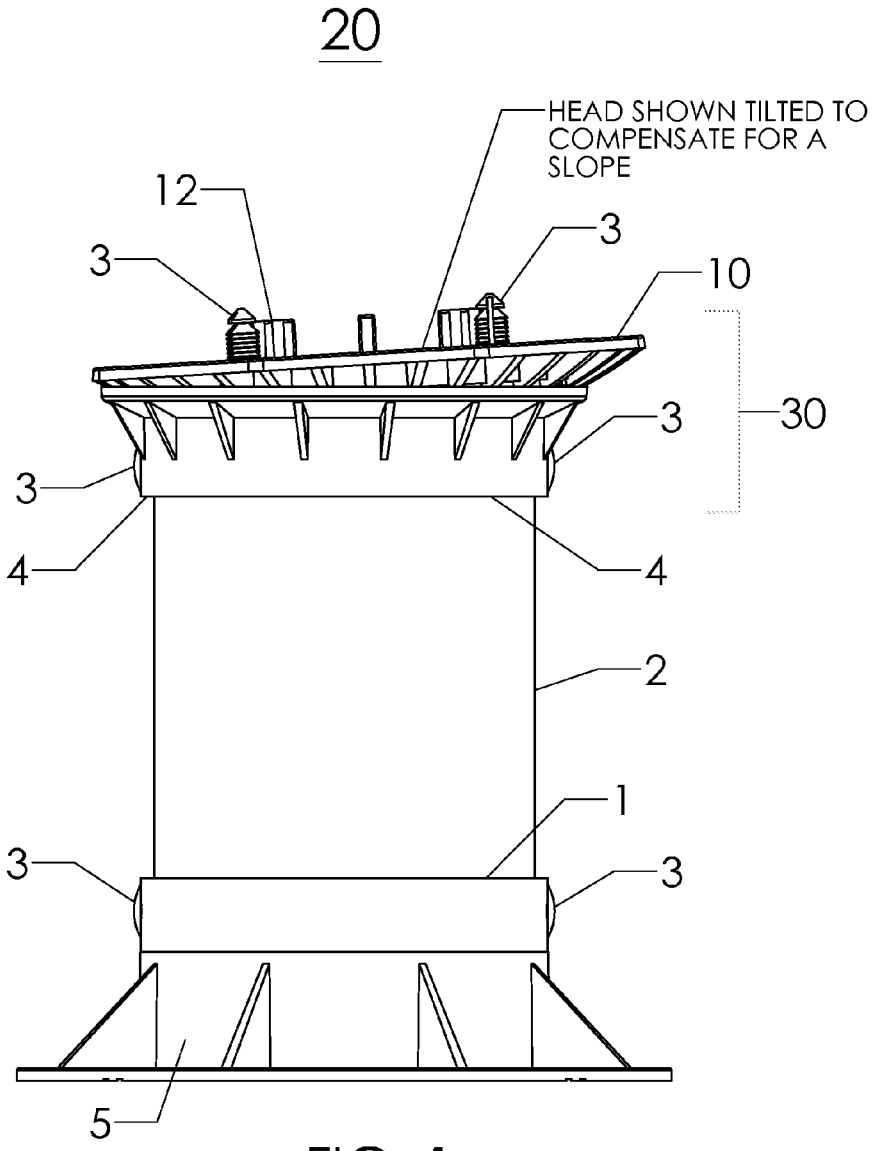
FIG. 1 is a perspective side view of an example of a pedestal of the present invention.

A List of Reference Numbers and the Parts to which They Refer

| | |
|---|---|
| 1 | Coupling. |
| 2 | Mid-section of PVC unthreaded pipe. |
| 3 | Fasteners. |
| 4 | Cap. |
| 5 | Base. |
| 6 | Locking washer. |
| 7 | Bolt. |
| 8 | Washer. |
| 9 | Zero compensator washer. |

-continued

| A List of Reference Numbers and the Parts to which They Refer | |
|---|---|
| 10 | Tiltable support-head. |
| 11 | Double-ended, multi-purpose bushing. |
| 12 | Spacing tabs. |
| 14 | Adapter. |
| 13 | Uplift protection washer having a narrow elongate slot. |
| 15 | Tightening bolt or screw. |
| 17 | Stationary jaw. |
| 18 | Moveable jaw. |
| 19 | Bolt. |
| 20 | Pedestal. |
| 22A | Aperture centered in tiltable support-head 10. |
| 22B | Aperture centered in bottom of well 44. |
| 24 | Aperture centered in cap 4. |
| 26 | Aperture centered in locking washer 6. |
| 30 | Leveling head assembly. |
| 32 | Top surface of tiltable support-head 10. |
| 34 | Bottom surface of tiltable support-head 10. |
| 36 | Top surface of cap 4. |
| 38 | Bottom surface of cap 4. |
| 43 | Attachment apertures. |
| 44 | Well suspended downward through the surface of tiltable support-head 10. |
| 50 | Top rim of the mid-section 2. |
| 60 | Joist support. |

It should be understood that the drawings are not necessarily to scale. In certain instances, details which are not necessary for an understanding of the present invention or which render other details difficult to perceive may have been omitted.

DETAILED DESCRIPTION

Referring now, with more particularity, to the drawings, it should be noted that the disclosed invention is disposed to embodiments in various sizes, shapes, and forms. Therefore, the embodiments described herein are provided with the understanding that the present disclosure is intended as illustrative and is not intended to limit the invention to the embodiments described herein.

The present inventive concept provides the principles that are used to make a leveling support pedestal system that is height adjustable and has a locking/titling leveling head. The pedestal levels, supports, and holds-down. That is, besides supporting and leveling the elevated surface that is being installed, the system is designed to secure the elevated surface against up-lift, from wind, for example. The inventive concept requires that the pedestal employs a single piece of non-threaded piping of predetermined length to provide the required elevated height. The example described herein uses inexpensive, readily available, strong and rigid PVC piping, although any piping that fills this need is contemplated within the scope of the invention. The principles provide for a leveling pedestal that is also able to secure the leveled, elevated surface deck-tiles, and the like, to a sub-floor that is at either a zero or a non-zero slope. To make final, small scale adjustments, rotatable means provided by the interaction of the base of the pedestal and a coupling section, provide for the pedestal to be raised or lowered vertically, as needed. To provide its leveling action, that is to compensate for sloped surfaces, the pedestal has a tilting head. For those cases where the slope of the sub-surface is zero degrees, the pedestal includes a zero compensator washer (zeroing plug) which locks the head of the pedestal to zero degrees. If the sub-surface is sloped, the zero compensator washer is removed so that the head can be tilted to the required slope of from zero degrees up to approximately seven degrees and then locked. In the exampled illustrated, the head is locked in position from the top of the pedestal by using the center tightening bolt/bushing-bolt mechanism as, in the example illustrated, comprises a washer having a narrow elongate slot, a bolt or the like, a double-ended multi-purpose bushing, and one or two locking washers. This fastener mechanism both secures the tiltable head in place at the desired slope and also secures the deck-tiles to the leveling head. On the supporting surface of the leveling head are four spacing tabs, each at a 90° orientation to its neighboring tabs, to space the deck-tiles being installed. The inventive principles also contemplate the pedestal used in a variety of different applications including variable height, sound insulation, and easing of maintenance. The self-leveling head can be, alternatively, provided with a joist support having a slide feature to permit joists of different widths to be securely fit therein. The center tightening bushing-bolt fastener mechanism also serves as an adapter for joist bracket accessory attachments, while maintain its ability to lock the angle of the head. An important part of the inventive concept is the fact that, if required, the entire pedestal may be adapted to be used in reverse, that is, literally upside down. When the pedestal is used in this orientation, it is the tiltable head that is securely attached to the sub-surface, and it follows then that what was the bottom side of the base would, in the reverse position, act to support the surface that is being installed. If desired, the pedestal could still be tightened from the top simple by have the bolt's position changed to the base instead of the head.

In more detail, the elevating leveling pedestal, used herein to illustrate the inventive concept, is made up of a threaded base rotatably attached to and supporting a threaded first end of a coupling. The base and coupling collectively provide a height adjustment mechanism for final small-scale adjustments. A second non-threaded end of the coupling is non-rotatably attached to, and supports, a first end of a non-threaded midsection of a pre-determined length. A second end of the midsection is non-rotatably attached to and supports a head assembly, thus providing a pedestal that supports, secures, and levels a surface being installed over a non-sloping or sloping sub-surface. The head assembly includes a support-head having a support surface overlying and attached to a cap having a centered cap aperture therethrough. Either the support-head or the cap have a convex mating surface while the other has a concave mating surface providing for said support-head and said cap to be slidably re-positionable along their mating surfaces. The support-head is, thus, tiltable with respect to the cap and it will be shown, is lockable between zero degrees and approximately seven degrees of tilt. The support-head further includes a centered recess, referred to as a recess aperture, in which is a bottomed-well having a centered-bottom-well aperture. Detachably attaching the support-head to the cap, is an assembly comprising a double-ended bushing having a first end and a second end, that is inserted, from the support-head's support surface down into the bottomed-well of the support-head, while from the bottom surface of the cap, an attachment device, such as a headed bolt, is inserted through an aperture of a locking washer and then up through an aperture in the cap to continue up through the bottom-well aperture until it securely engages with said second end of said double-ended bushing. Once the support-head has been tilted, as required, by slidably re-positionable the support-head along the mating convex/concave surfaces of the support-head and the cap, the support-head can be securely locked at the desired angle, for example, by inserting a hex-wrench into the hex-accepting first end of the bushing aperture and turning the wrench until the desired amount of locking tightness is achieved effectively locking said support-head in a tilted position from zero to approximately seven degrees. Depending on the tolerance in the apertures, the degrees of tilt may extend pass seven degrees to an amount measured in degree minutes. When there is no slope that requires compensation, there is available a zero compensator washer that rapidly and easily locks the support-head at zero degrees. The pedestal further comprises a washer having a narrow elongate slot emanating from the washer's center to its edge, with the slot being of a width no wider than that required for the slot to just fit about the stem of a center-tightening device, such as a bolt or a screw, that extends through the center—most portion of said slot into said double-ended bushing. As a raised surface, such as decking tiles, is installed over a sub-surface, pre-made slots in the sides of the decking tiles accept the slotted washer. The washer, thus, provides a hold-down preventing the raised surface from being lifted, by the wind, for example. The support-head further comprises, on its support surface, spacer tabs that space the deck-tiles or said deck-boards being installed. The spacer tabs are either molded with said support-head or are positioned into slots molded into said support-head, as required. In the case where the spacer tabs are molded with support-head, they are available scored making them easily removed if not needed. In most cases, the spacer tabs are each positioned at a 90° orientation to a neighboring tab. Additionally, the support surface of the support-head is available provided with a joist support having a slide feature to permit joists of different widths to be securely fit therein. The structure of the pedestal is designed to allow the pedestal to be easily adapted to be used in reverse orientation.

Figure 9:
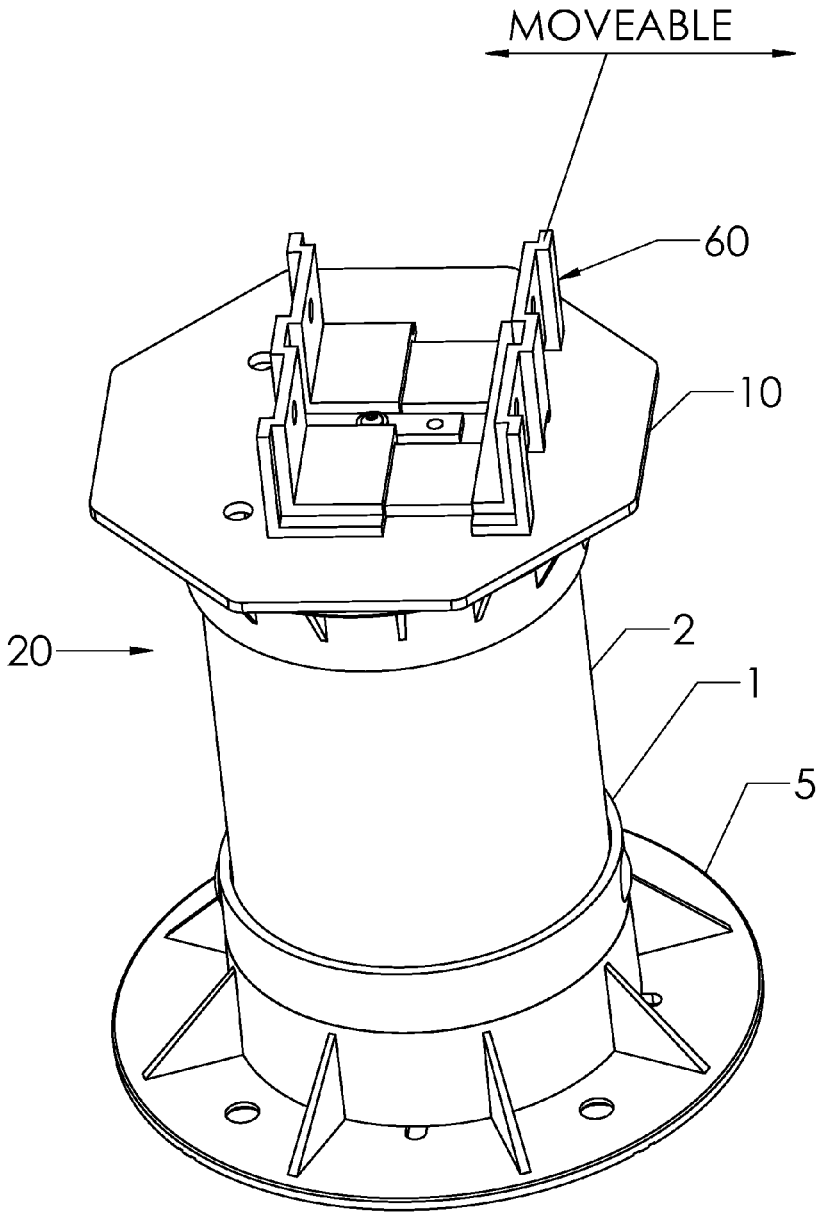
FIG. 9 is another perspective view illustrating a joist support accessory.

Turning now to the drawings, FIG. 1, a perspective view, illustrates one example of pedestal device 20. Pedestal device 20 comprises flanged cylindrical threaded base section 5 that in this example is rotatably attached to a threaded first end of, and supports, coupling 1 that, in turn, is connected to and supports a first end of a pre-determined length, non-threaded, mid-section 2, which is the major, load-bearing support of pedestal 20. Mid-section 2 offers greater strength and rigidity than currently available systems by being manufactured from a single, non-threaded section of PVC piping that is low cost, standard, and readily available. The increased rigidity and strength of the mid-section of the present invention is due to the fact that it consists of a single unit of non-threaded PVC pipe 2 that is precut to the length required. This means that the walls of the mid-section are not thinned by the incisions required by a threaded surface or by any connecting divisions that would be required for a multi-piece supporting mid-section. To provide for height adjustment, presently available devices rely on multiple threaded units to build up to the height required. Both the connection areas between the various units and the incised-threaded walls of the units contribute to reducing the rigidity and strength of these supports, while increasing the overall unit cost. A second end of mid-section 2 non-rotatably attached to, and supports, cap 4 on top of which sits tiltable support-surface head 10. In FIG. 1 tiltable support-surface head 10 is illustrated in a tilted position. Cap 4 and tiltable support-surface head 10 together form leveling head assembly 30. The inventive principles provided by assembly 30 include the ability of the pedestal to be tilted to accommodate the requirements of the elevated surface being installed on a non-level sub-surface along with the ability of the head to be locked into any angle between the horizontal up to an angle of approximately seven degrees. Additionally, the upper surface of head 10 supports spacing tabs 12 for the correct spacing of the elevated surface pieces being installed or, alternatively, the upper surface of head 10 supports a joist support for the installation of elevated joists, as illustrated in FIG. 9. Moreover, assembly 30 is provided with uplift protection washers 13 (illustrated in FIG. 2) to protect the elevated surface from wind uplift. Assembly 30 can be a stand-alone feature of the present invention in that it can be used as described, or can be used with other, different pedestals, such as with pedestals that depend on threaded intersections and midsections to obtain the pedestal height required.

Figure 2:
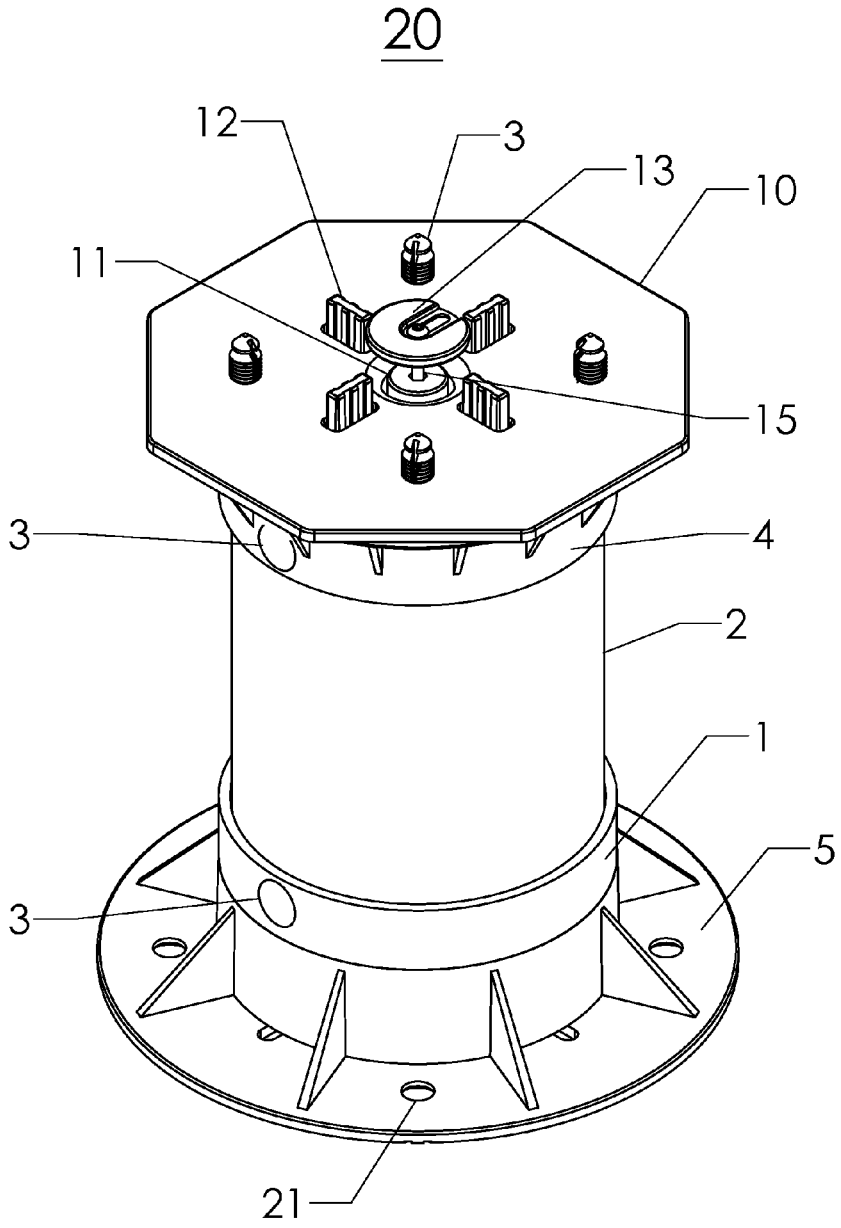
FIG. 2 is a perspective oblique view of the pedestal, as shown in FIG. 1.

FIG. 2, a perspective, oblique view of pedestal 20, more clearly illustrates the top surface of tiltable support-head 10 and the top surface of base 5. On the surface of tiltable support-head 10 are shown fasteners 3, spacing tabs 12, the top end of multi-purpose bushing 11, washer 13 having a slot that is narrow and elongate, and tightening bolt 15 going through the center of double-ended bushing 11 and narrowly slotted washer 13. Also illustrated are attachment apertures 21 through the plate-like part of base 5 for attachment of the pedestal to the subsurface.

Figure 3:
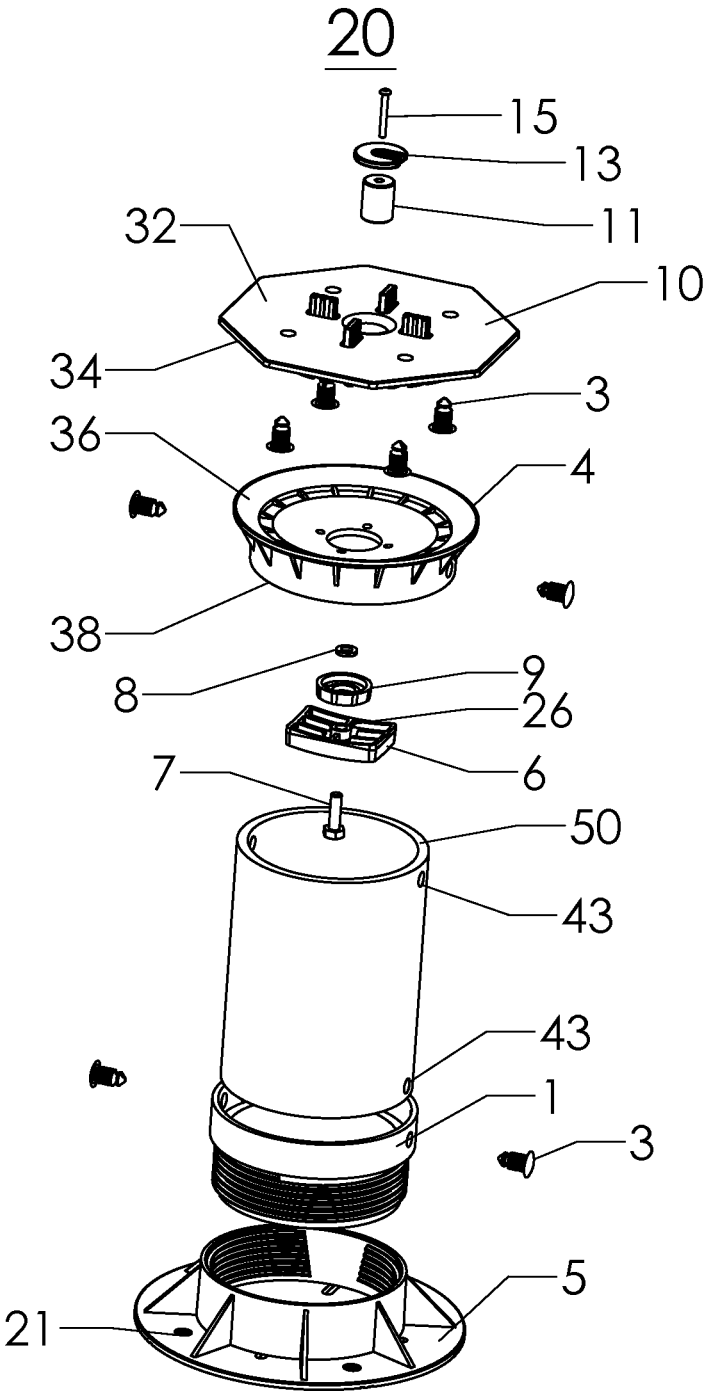
FIG. 3 is an exploded view of the pedestal, as shown in FIGS. 1 and 2.
Figure 4A:
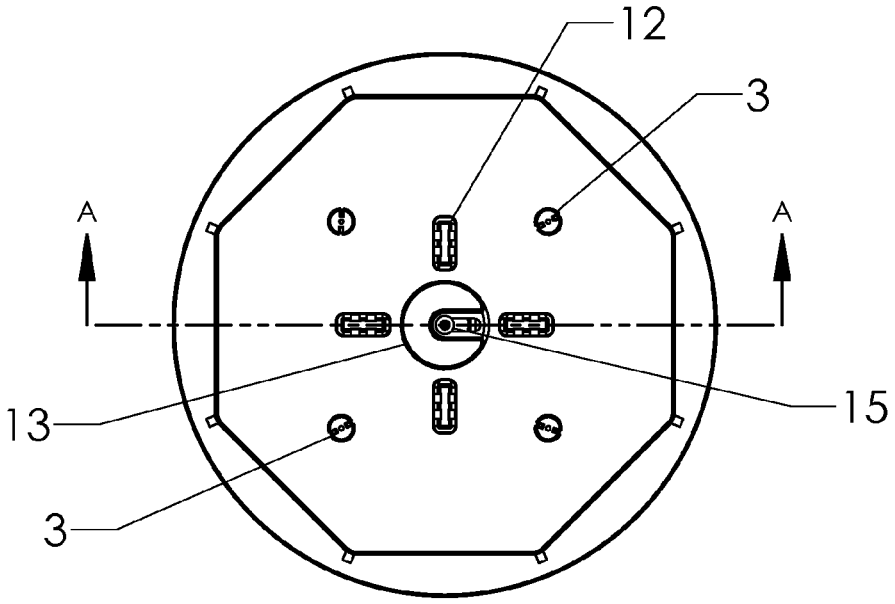
FIG. 4A is a plan view of a pedestal of the present invention.
Figure 4B:
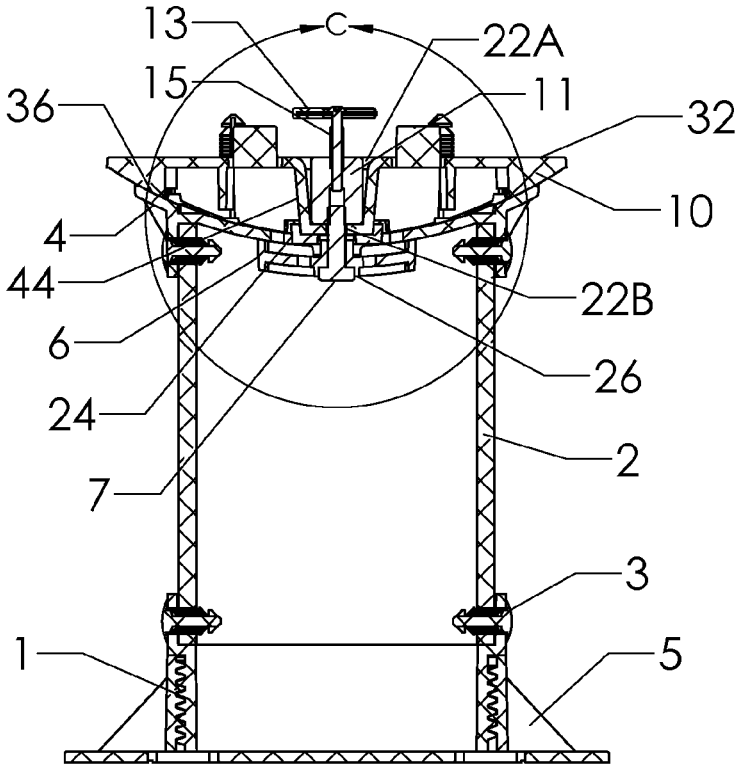
FIG. 4B is a section view of a pedestal taken along line A-A of FIG. 4A.
Figure 4C:
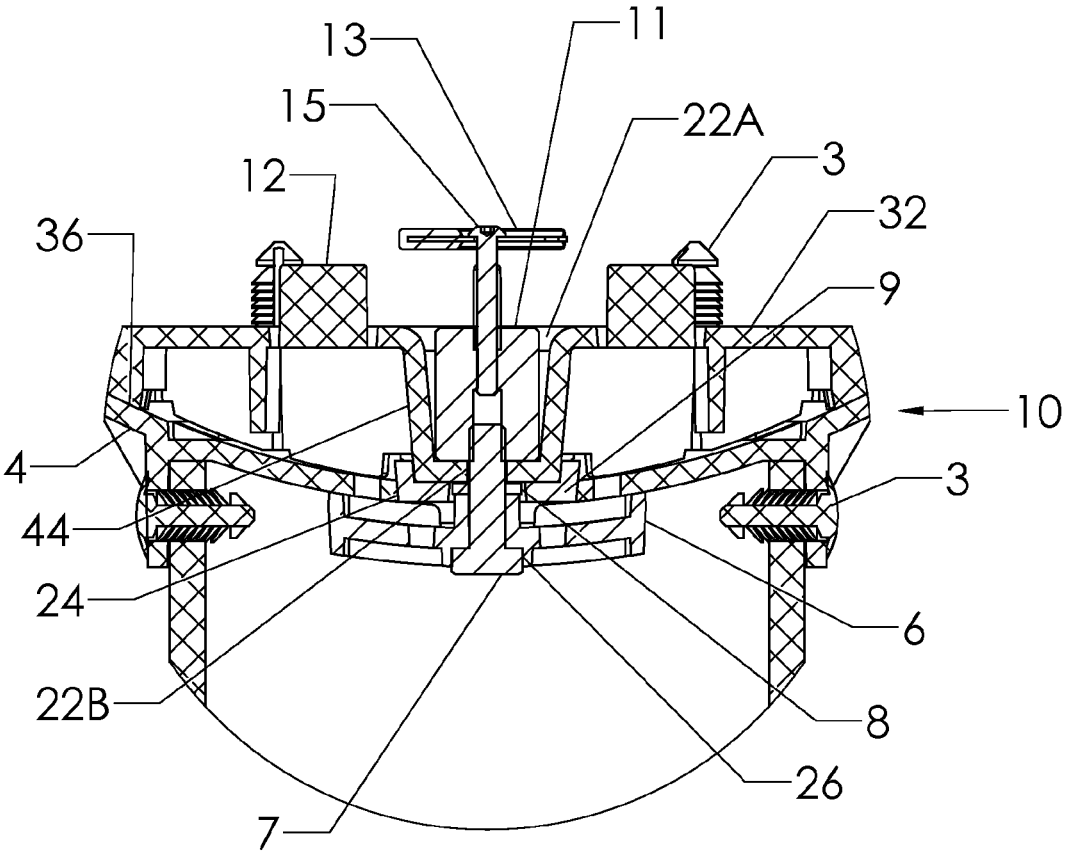
FIG. 4C is a close-up of area "C" as shown is FIG. 4B.

FIG. 3, an exploded view of the pedestal, FIG. 4B, a cross-section view, and FIG. 4C, illustrate the construction of pedestal 20. In the example shown, base 5, with its flanged base, is internally threaded to receive the threads on a first end of coupler 1. It is to be understood that base 5 could have external threading, while the mating end of coupler 1 could be externally threaded. It should be noted that in this example coupler 1 and base 5 each utilize six mating threads per inch to provide for fine-tuning the height of the unit. Even though the threading is kept to a minimum to enhance the strength of the base, in this example, base 5 is additionally strengthened by a series of spaced vertical flanges about the base. A second, not-threaded, end of coupler 1 is structured to couple with a first end of non-threaded mid-section 2 of a predetermined length. The length of mid-section 2 is determined by the specified height for each project. In the example shown, the first end (bottom end in this example) of mid-section 2 serves as the male couple part and the second end (top end in this example) of coupler 1 serves as the female accepting couple part, but the inventive principles also contemplate the reverse coupling situation. In any case, once the top section of coupler 1 is non-rotatably coupled with the bottom area of mid-section 2, the two sections are securely attached to each other using fasteners 3 that in this case are Christmas tree or automotive type fasteners, but any fasteners that will work as intended are contemplated by the invention. The rotating, tiltable, support-head assembly 30 (better appreciated in FIG. 1) is designed to sit on, and to be attached to, the top rim 50 of mid-section 2. The two basic components of adjustable leveling support-head assembly 30 comprise flanged cap 4 and tiltable support-head 10. Adjustable leveling support-head assembly 30 compensates for the difference in slope between the sub-surface and the surface being installed and supported by an array of pedestals 20. Downward facing surface 34 of tiltable support-head 10, in this example, is convex so as to be supported by and slidably re-positionable on the concave surface 36 of cap 4. As is known in the art, the convex concave relationship could be reversed, that is cap 4 could have the convex surface and tiltable support-head 10 the concave shaped surface, to obtain the same result. Both of these relationships are contemplated by the inventive concept. The center area of tiltable support-head 10 is recessed forming bottomed-well 44 within recess aperture 22A. Through the bottom of well 44 there is centered well-bottom aperture 22B. Cap 4 has centered cap aperture 24 therethrough. To detachably, but securely, attach tiltable support-head 10 to cap 4, double-ended bushing 11 is placed inside bottomed-well 44 with headed-screw 7, or bolt, inserted up through aperture 26 of locking washer 6 to continue through washer 8 that is positioned within aperture 24 and to further continue through centered aperture 22B in the bottom of well 44 and into multi-use bushing 11. Adjustable leveling support-head assembly 30 is now ready to be placed about and secured to top-rim 50 of mid-section 2. Adjustable leveling support-head 30 is secured to top-rim 50 of mid-section 2 using fasteners 3 positioned through fastening apertures 43. Tiltable support-head 10 is now ready to be tilted to compensate for the angle of the sub-surface. Enlarged aperture diameters make possible the tilting of tiltable support-head 10 between 0 and approximately seven degrees. Tiltable support-head 10 is simply adjusted until it is set at the desired angle of between 0 and approximately seven degrees. Tiltable support-head 10 is then locked at the desired angle by inserting a hex-wrench into the, in this example, hex-accepting tightening bushing aperture and turning the wrench until the desired amount of locking tightness is achieved. The ability to both position and lock the tiltable head at any infinite position of between 0 and approximately seven degrees while having uplift protection is not, to the best of Applicant's knowledge, achievable by any other pedestal device. To achieve any final height adjustment that may be required base 5 may be rotated to increase or decrease the height, as required. When pedestal 20 is being positioned on a horizontally flat sub-surface zero-compensating washer 9 (see FIG. 3) is inserted between locking washer 6 and lower surface 38 of cap 4. The use of zero-compensating washer 9 provides for rapidly achieving an accurate zero-tilted tiltable head providing for a quicker setup. Additionally, the fact that zero-compensating washer 9 can be locked when in a zero degree angle presents an otherwise unavailable rigidity where other adjustable, but not lockable, heads may easily slip out of the zero degree position. Tiltable support-head 10 can receive and support four spacer tabs 12 if desired for spacing of deck-tiles being installed. In the example taught herein, the means for receiving and supporting the spacer tabs are slots molded into tiltable support-head 10. It should be understood that any means that will receive and support the spacer is contemplated by the inventive principles. Additionally, it should be understood that head 10 is also available with the spacers molded as part of the head. In this case, when one or more such spacers are not required, a spacer may be removed by simply bending it about the scoring provided to easily and rapidly remove the spacer.

Figure 5A:
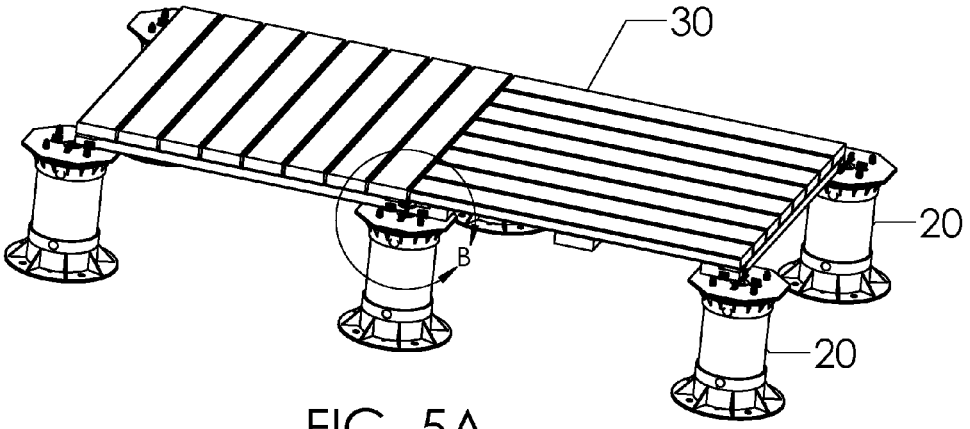
FIG. 5A is a perspective of an example of the invention in use.
Figure 5B:
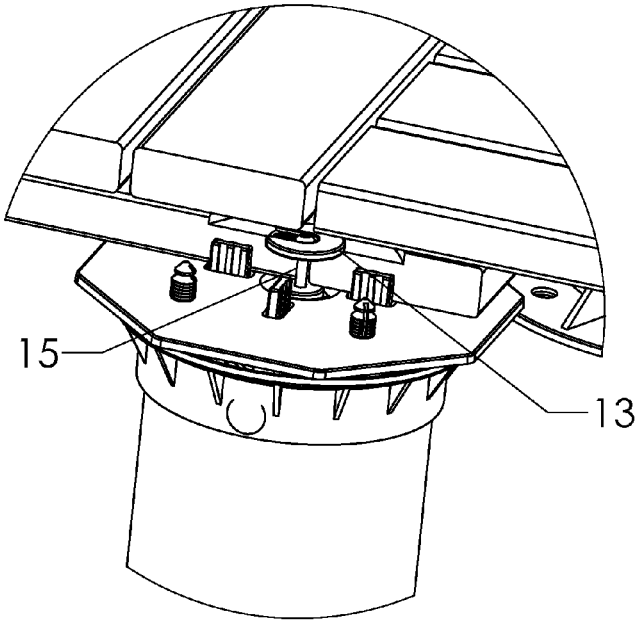
FIG. 5B is a close-up view of the area "B" as shown in FIG. 5A.

FIG. 4A, a plan view, illustrates how pedestal 20 of the present invention provides uplift protection to the surface being installed. Plastic-coated metal hold-down washer 13, having a narrow slot only as wide as tightening bolt 15 extending from the washer's center to its outer edge, provides a maximum amount of surface area that is to be inserted into the pre-cut notches of the surface material being installed. It is this surface area that provides the means to hold-down the surface being installed. Note, that although washer 13 is a plastic-coated washer in the example illustrated, the washer can be of any material that provides the function required. It should be noted that the hold-down washer of the present invention does not need to be positionally rotated in order to have the washer engaging all four intersecting corners of the deck-tiles being installed, as is required by others who use a washer having a larger cut-out area. Thus, with no rotation required, hold-down washer 13 is simply slid into place. Washer 13 is used in conjunction with headed tightening bolt 15 and double-ended bushing 11. First tightening bolt 15 is inserted into, in this example, a hex-accepting busing aperture and then the narrow elongate slot of washer 13 is positioned about bolt 15. A deck-tile panel is then placed on a pedestal that has been so equipped with washer 13 positioned about bolt 15, so that, as shown in FIGS. 5A and 5B, each deck-tile accepts approximately one-quarter of the of hold-down washer 13. A quick turn of a tightening tool about tightening bolt 15 assures that hold-down washer 13 is securely in place to hold down the deck-tiles, thus providing up-lift protection for the newly installed deck-tiles. For ease of maintenance to infrastructure beneath the deck-tiles, or whatever other raised surface is installed using the present invention, tightening bolt 15 can be loosened and washer 13 can be slide out from the groove so that the deck-tiles can be removed and the work required performed beneath the raised floor. Once work is completed the deck-tiles can easily be reinstalled and the washer 13 slide back into place and tightened with tightening bolt 15. Illustrated in FIGS. 1-5B projecting upward from the upward facing surface of head 10 is a set of four fasteners 3. These four fasteners 3 may be used for both positioning the elevated surface being installed and for providing added protection against up-lift of the elevated surface. On the underside of the elevated surface being installed there may be, if desired, apertures spatially arranged for receiving fasteners 3.

Figure 6:
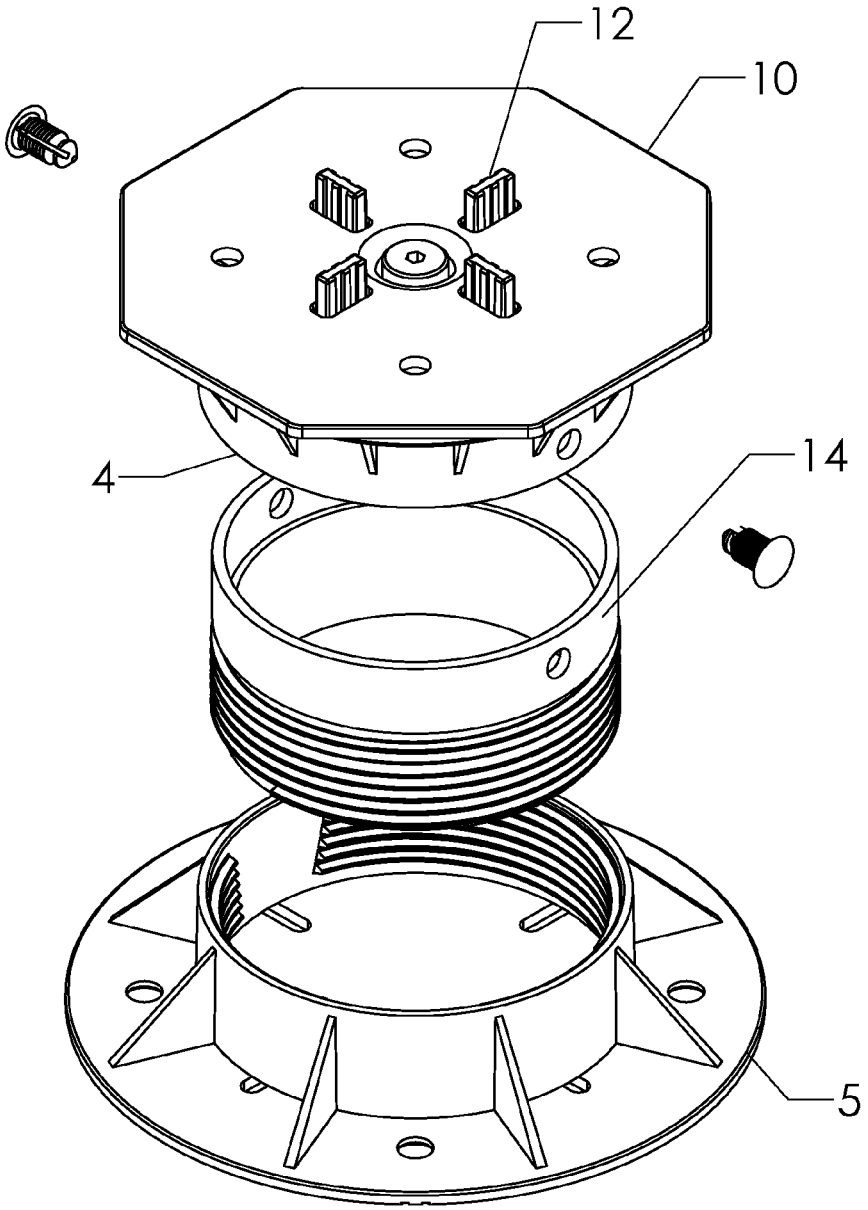
FIG. 6 is an exploded view to illustrate an adapter.

Clearly shown in FIG. 6 are four tabs 12 on tiltable support-head 10 that are used for spacing of the deck-tiles. These four tabs can be individually removed if not needed. Also illustrated in FIG. 6 is adapter 14. If a shorter stack height for the pedestal is required both mid-section 2 and coupling 1 can be exchanged for adapter 14.

In some instances, raised deck floors are installed on an upper story, such as a roof top. This can happen often if entertainment space is needed but there is no land surface available, such as in a densely populated area. If the raised deck was installed over a living space where quiet was appreciated, the sound created by entertainment on the deck could be intrusive. In such an instance, it would be desirable to include sound insulation in the deck installation. With the present system this is easily accommodated by simply inserting a rubber sound-proofing pad between tiltable support-head 10 and the deck-tiles.

Figure 7:
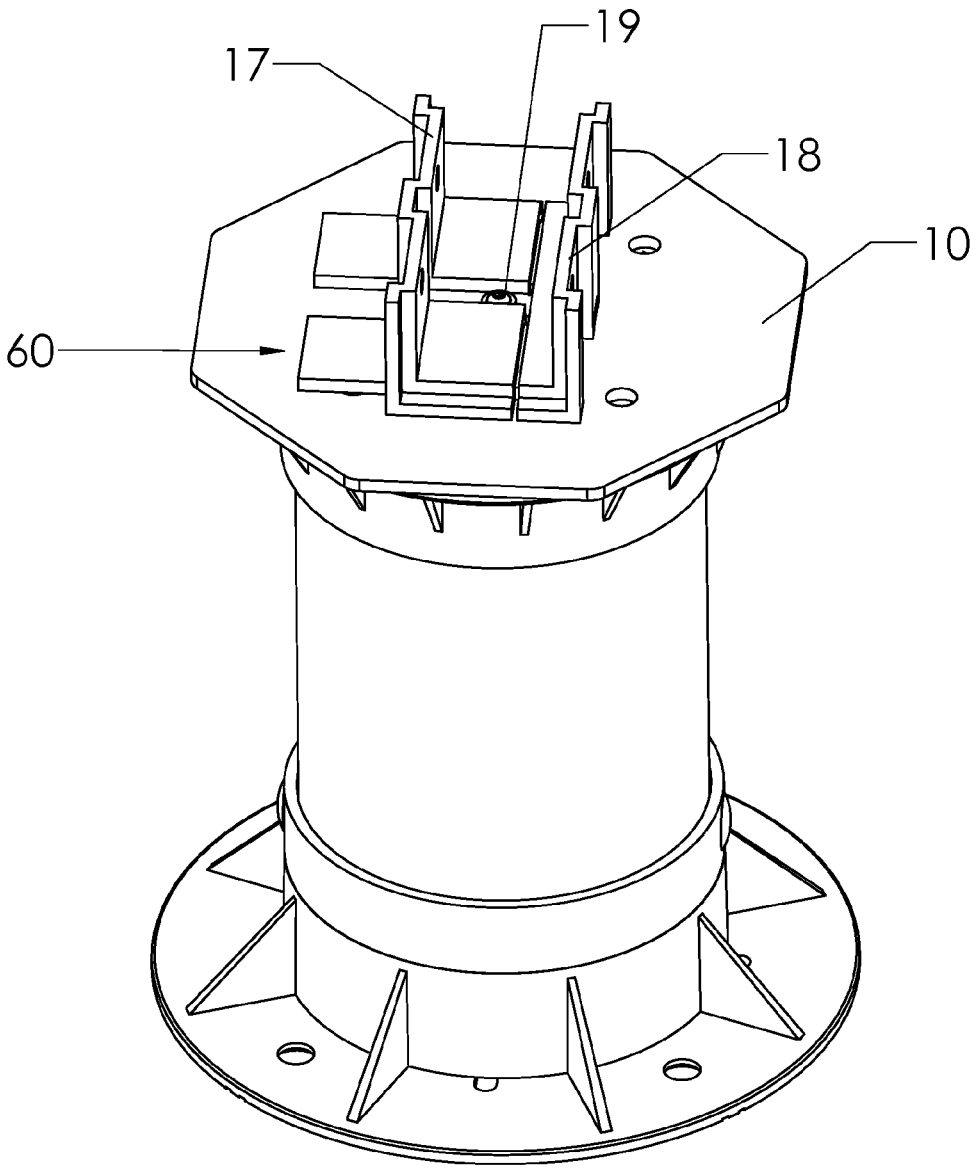
FIG. 7 is a perspective view illustrating a joist support accessory.
Figure 8:
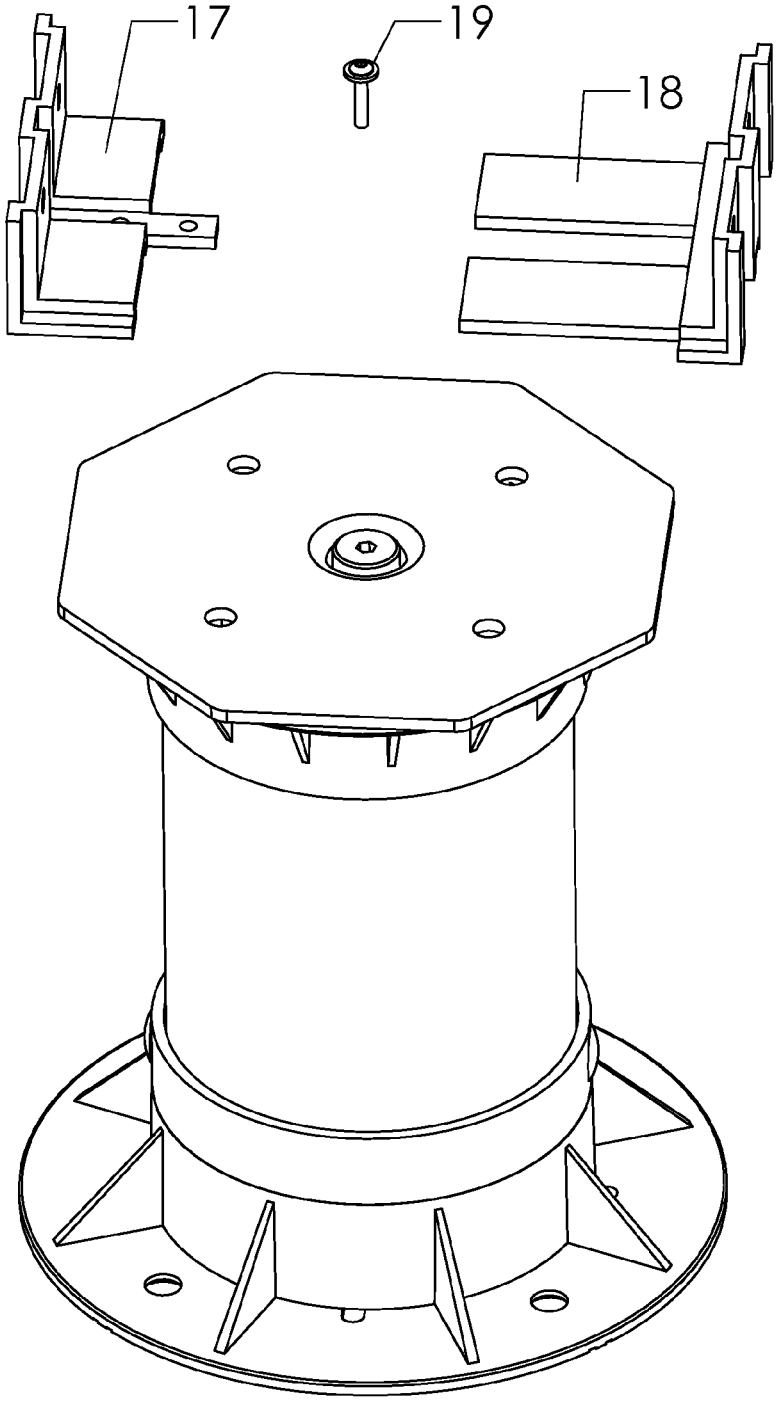
FIG. 8 is an exploded view of the joist support accessory, as shown is FIG. 7.
Figure 10:
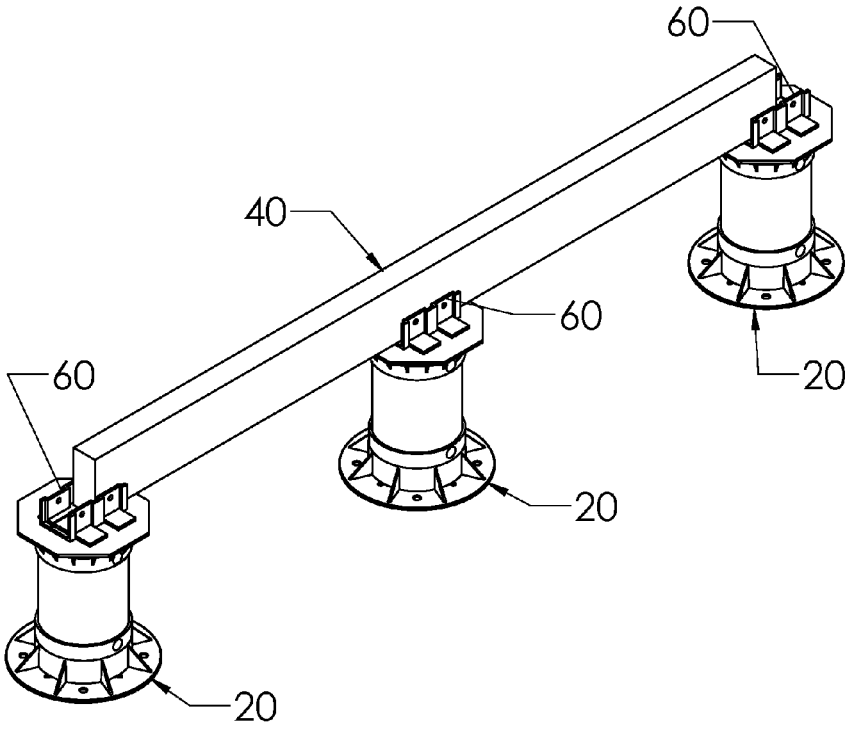
FIG. 10 is a perspective view illustrating a joist support accessory in use.

There are instances when the installation of a raised surface would be better served by installing the raised surface on support joists which are raised. Pedestal 20 accomplishes this by providing secure support for construction joists instead of floor tiles, or the like. Thus, the inventive principles provide for tiltable support-head 10 to be designed with accessory joist support 60 as illustrated in FIGS. 7-10. Tiltable support-head 10 is available with removable spacer tabs 12 or without spacer tabs. When molded with the spacer tabs scoring is placed on the spacers near the surface of head 10 for the purpose of removing any spacers not needed. Thus, tiltable support-head 10 can be used for additional purposes such as supporting joist support 60. Joist support 60 consists of the two part component as shown in the example illustrated in FIG. 7. Stationary jaw 17 part of joist support 60 is attached to tiltable support-head 10 by securing bolt 19 through the attachment aperture of stationary jaw to double-ended, multi-purpose bushing 11. Moveable jaw 18 is slidably attached to stationary jaw 17 to accommodate joists of various widths. Stationary jaw 17 attachment part has multiple attachment apertures so it can be used with much wider or double joists in efforts to keep each joist centered over tiltable support-head 10 to evenly distribute weight over pedestal system. FIG. 8 illustrates the exploded parts of joist support 60. FIG. 7 illustrates accessory joist support 60 with moveable jaw 18 slid in toward stationary jaw 17, while FIG. 9 illustrates accessory joist support 60 with moveable jaw 18 slid a distance away from stationary jaw 17. FIG. 10 shows three pedestals 20 each being used in combination with joist support 60 according to the principles of the present invention to support joist 40.

The foregoing description, for purposes of explanation, uses specific and defined nomenclature to provide a thorough understanding of the invention. However, it will be apparent to one skilled in the art that the specific details are not required in order to practice the invention. Thus, the foregoing description of the specific embodiment is presented for purposes of illustration and description and is not intended to be exhaustive or to limit the invention to the precise form disclosed. Those skilled in the art will recognize that many changes may be made to the features, embodiments, and methods of making the embodiments of the invention described herein without departing from the spirit and scope of the invention. Furthermore, the present invention is not limited to the described methods, embodiments, features or combinations of features but include all the variation, methods, modifications, and combinations of features within the scope of the appended claims. The invention is limited only by the claims.

What is claimed is:

1. An elevating leveling pedestal, comprising:

a threaded base;

a coupling with a threaded first end and a non-threaded second end;

a non-threaded midsection of a specified length providing a height, said midsection having a non-threaded first end and a non-threaded second end, and a leveling head assembly;

said threaded base rotatably attached to said threaded first end of, and supporting, said coupling, said base and said coupling collectively creating a height adjustment mechanism for said pedestal, said non-threaded second end of said coupling non-rotatably attached to said non-threaded first end of, and supporting, said midsection, with said non-threaded second end of said midsection non-rotatably attached to and supporting said leveling head assembly creating said pedestal, said pedestal structured to support, secure, and level a surface being installed over a non-sloping or sloping sub-surface.

2. The pedestal, as recited in claim 1, wherein said leveling head assembly further comprises a single-body structured tiltable support-head having a support surface, and a cap having a centered cap aperture, said tiltable support-head overlying and attached to said cap with a single attachment device within said centered cap aperture, with one of said tiltable support-head and said cap having a convex mating surface and the other of said tiltable support-head and said cap having a concave mating surface making said tiltable support-head and said cap slidably re-positionable with respect to each other along their mating surface resulting in tiltable support-head being tiltable with respect to said cap.

3. The pedestal, as recited in claim 2, further comprising:

a recess centered in said support surface of said tiltable support-head, said recess forming a bottomed-well and defining a tiltable support-head recess aperture, and a centered bottom-well aperture through the bottom of said bottomed-well, a double-ended bushing having a first end and a second end positioned within said bottomed well, an attachment device, and a locking washer, said attachment device and said locking washer enabling detachable attachment of said tiltable support-head to said cap when said tiltable support-head having said double-ended bushing positioned within said bottomed-well is positioned over said cap, and said attachment device is inserted through said locking washer and through said centered cap aperture into and fixedly engaging with said second end of said double-ended bushing.

4. The pedestal, as recited in claim 3, wherein the structure of said pedestal allows the pedestal to be adapted for use in reverse orientation.

5. The pedestal, as recited in claim 2, wherein said tiltable support-head is tiltable with respect to said cap between zero degrees and approximately seven degrees of tilt.

6. The pedestal, as recited in claim 5, wherein said tiltable support-head capable of being locked in an infinite number of tilt positions between zero degrees and approximately seven degrees.

7. The pedestal, as recited in claim 5, wherein said first end of said double-ended bushing is structured to accept a tightening wrench so that when said tightening wrench is inserted into said first end of said double-ended bushing and turned in a tightening direction, said tiltable support-head is locked is a desired tilt angle.

8. The pedestal, as recited in claim 7, wherein said support-head further comprises:

a washer, and a tightening device, said washer having a narrow elongate slot emanating from the washer's center to its edge, said slot being of a width no wider that a width required for the slot to fit about a stem of said tightening device when said stem is inserted through said slot into said first end of said double-ended bushing effectively locking said tightening device in place providing uplift protection to the surface being installed.

9. The pedestal, as recited in claim 2, further including a zero compensator washer that locks said support-head at zero degrees.

10. The pedestal, as recited in claim 2, wherein said tiltable support-head further comprises spacer tabs on its support surface, said spacer tabs structured for spacing said deck-tiles or said deck-boards being installed.

11. The pedestal, as recited in claim 10, wherein said spacer tabs are molded with said tiltable support-head or are positioned into slots molded into said tiltable support-head.

12. The pedestal, as recited in claim 11, wherein said spacer tabs that are molded with tiltable support-head are scored making them removable if not needed.

13. The pedestal, as recited in claim 10, wherein said spacer tabs are each positioned at a 90° orientation to its neighboring tabs.

14. The pedestal, as recited in claim 10, further comprising a rubber sound-proofing pad between said pedestal and the deck-tiles forming a sound barrier.

15. The pedestal, as recited in claim 2, wherein said support surface of said tiltable support-head is provided with a joist support having a slide feature, said slide feature structured to receive joists of different widths.

16. The pedestal, as recited in claim 1, wherein said surface is a raised flooring surface.

17. The pedestal, as recited in claim 16, wherein said flooring surface further comprises are deck-tiles or deck-boards.

18. An elevating leveling pedestal, comprising:

a threaded base;

a coupling with a threaded first end and a non-threaded second end;

a non-threaded midsection of a specified length providing a height, said midsection having a non-threaded first end and a non-threaded second end, and a leveling head assembly;

said threaded base rotatably attached to said threaded first end of, and supporting, said coupling, said base and said coupling collectively creating a height adjustment mechanism for said pedestal, said non-threaded second end of said coupling non-rotatably attached to said non-threaded first end of, and supporting, said midsection, with said non-threaded second end of said midsection non-rotatably attached to and supporting said leveling head assembly creating said pedestal, said pedestal structured to support, secure, and level a surface being installed over a non-sloping or sloping sub-surface, said leveling head assembly further comprising:

a single-body structured tiltable support-head having a support surface, said tiltable support-head lockable in any an infinite number of tilt positions between zero degrees and approximately seven degrees, and a cap having a centered cap aperture, said tiltable support-head overlying and attached to said cap with a single attachment device within said centered cap aperture, with one of said tiltable support-head and said cap having a convex mating surface and the other of said tiltable support-head and said cap having a concave mating surface making said tiltable support-head and said cap slidably re-positionable with respect to each other along their mating surface resulting in said tiltable support-head being tiltable with respect to said cap.

19. The elevating leveling pedestal, as recited in claim 18, further comprising:

a recess centered in said support surface of said tiltable support-head, said recess forming a bottomed-well and defining a tiltable support-head recess aperture, and a centered bottom-well aperture through the bottom of said bottomed-well, a double-ended bushing having a first end and a second end positioned within said bottomed well, an attachment device, and a locking washer, said attachment device and said locking washer enabling detachable attachment of said tiltable support-head to said cap when said tiltable support-head having said double-ended bushing positioned within said bottomed-well is positioned over said cap, and said attachment device is inserted through said locking washer and through said centered cap aperture into and fixedly engaging with said second end of said double-ended bushing.

20. A method of making an elevating leveling pedestal, which comprises the steps of:

providing a threaded base;

providing a coupling with a threaded first end and a non-threaded second end;

providing a non-threaded midsection of a specified length providing a height having a non-threaded first end and a non-threaded second end, and providing a leveling head assembly;

rotatably attaching said threaded base to said threaded first end of, and supporting, said coupling, said base and said coupling collectively creating a height adjustment mechanism for a pedestal, non-rotatably attaching said non-threaded second end of said coupling to said non-threaded first end of, and supporting, said midsection, and non-rotatably attaching said non-threaded second end of said midsection to and supporting said leveling head assembly creating said pedestal, said pedestal structured to support, secure, and level a surface being installed over a non-sloping or sloping sub-surface, providing said leveling head assembly to further comprise:

a single-body tiltable support-head having a support surface, said tiltable support-head lockable in any an infinite number of tilt positions between zero degrees and approximately seven degrees, and a cap having a centered cap aperture, said tiltable support-head overlying and attached to said cap with a single attachment device within said centered cap aperture, and having one of said tiltable support-head and said cap having a convex mating surface and the other of said tiltable support-head and said cap having a concave mating surface making said tiltable support-head and said cap slidably re-positionable with respect to each other along their mating surface resulting in said tiltable support-head being tiltable with respect to said cap.

* * * * *